United States Patent [19]

Dodson et al.

[11] Patent Number: 4,949,425

[45] Date of Patent: Aug. 21, 1990

[54] SPRING LOADED BLOCK AND TACKLE WINDOW SASH BALANCE ASSEMBLY

[75] Inventors: Earl L. Dodson, Elliston, Va.; Frederick P. Strobl, Jr., Cary, Ill.

[73] Assignee: American Balance Corporation, Roanoke, Va.

[21] Appl. No.: 259,419

[22] Filed: Oct. 19, 1988

Related U.S. Application Data

[63] Continuation of Ser. No. 922,998, Oct. 24, 1986, abandoned.

[51] Int. Cl.[5] ..... E05F 1/16

[52] U.S. Cl. ..... 16/198; 16/DIG. 16; 16/DIG. 31; 16/197; 16/DIG. 20; 16/213; 49/446; 49/429; 49/414

[58] Field of Search ..... 16/193, 197, 211, 212, 16/213, 214, DIG. 16, DIG. 31, 198; 49/445, 446, 451, 414, 429, 441, 430, 431, 432

[56] References Cited

U.S. PATENT DOCUMENTS

| | | | |
|---|---|---|---|
| 2,262,990 | 11/1941 | Cross | 16/197 |
| 3,054,152 | 9/1962 | Trammell | 49/430 |
| 3,086,259 | 6/1963 | Klein | 49/446 |
| 3,091,797 | 6/1963 | Prosser | 49/445 |
| 3,114,178 | 12/1963 | Wood | 16/197 |
| 4,078,336 | 3/1978 | Prosser | 49/445 |
| 4,089,085 | 5/1978 | Fitzgibbon | 16/197 |
| 4,190,930 | 3/1980 | Prosser | 16/197 |

*Primary Examiner*—Richard K. Seidel
*Assistant Examiner*—Edward A. Brown
*Attorney, Agent, or Firm*—Staas & Halsey

[57] ABSTRACT

A pre-assembled, spring loaded, block and tackle window sash balance assembly is adapted for providing vertical support for a window sash running in an elongated, generally upright sash run having a generally C-shaped guide channel extending along its plow region. The assembly comprises a generally U-shaped housing for a block and tackle spring balance device. The assembly further includes spaced slide means which are discrete from the housing itself and which are slidably interengageable with the guide channel for removeably attaching the assembly to the sash run. Accordingly, the block and tackle balance assembly may be pre-assembled and then conveniently and efficiently attached to the sash run and supported in a position to provide spring balanced support for a window sash mounted in the sash run.

17 Claims, 2 Drawing Sheets

SPRING LOADED BLOCK AND TACKLE WINDOW SASH BALANCE ASSEMBLY

This is a continuation of Ser. No. 922,989, filed 10/24/86, now abandoned.

BACKGROUND OF THE INVENTION

1. Field of the Invention

The present invention relates to spring balanced window sash constructions and in particular to block and tackle devices for use in connection with such constructions. More particularly, the present invention pertains to a unitary, spring loaded, block and tackle balance mechanism which is adapted for pre-assembly and includes means for facilitating the final installation and assembly of the window structure.

2. The Prior Art

Block and tackle devices for use in connection with spring balancing of window sashes are well known. Such devices are illustrated in prior Cross et al., U.S. Letters Patent Nos. 2,262,990; Trammell, Jr. U.S. Pat. No. 3,054,152; Prosser U.S. Pat. No. 3,091,797; Wood U.S. Pat. No. 3,114,178; and Fitzgibbon U.S. Pat. No. 4,089,085. Such devices have gained acceptance because they permit the use of smaller, more compact balance springs and the operation is such that the lengthening of the spring during operation is minimized. Moreover, the block and tackle devices facilitate the positioning of the spring and the overall assembly of the window unit in that through the use of block and tackle devices, the spring may, in use, be pulled either upwardly or downwardly and may be carried by either the window sash or the jam structure. Generally speaking, when block and tackle spring balance devices are employed, the pull of the spring and the force of gravity are more easily balanced to the end that additional braking devices are not required.

The basic problem which has been encountered in connection with block and tackle spring balance mechanisms in the past is that the same are not easily adapted to facilitate pre-assembly for efficient and economical initial installation and/or removal in the event of malfunction. Accordingly, manufacturing costs have been high, and maintenance and warranty difficulties have made such devices less than enthusiastically received by some segments of the industry. On the other hand, the general concept of pre-assembly of block and tackle devices is not unknown.

The stated problems have been encountered and solutions have been attempted, particularly in the disclosures of the patents identified above. Generally speaking, however, these prior art structures have presented manufacturing and assembly difficulties which are substantially overcome by the device of the present invention. In particular, Prosser, in his '797 patent, discloses a pre-assembled structure which is held in place by tongues and grooves and flanges bent from the housing itself. The Prosser connecting means must be carefully positioned so as to meet and mate complimentarily with openings bent and stamped out of the jam liner. Such construction obviously creates alignment and assembly problems in view of the fact that the various tongues and flanges and grooves and openings must be perfectly aligned in order for the assembly to conveniently take place. Moreover, the Prosser construction is not adapted for use in connection with modern thermoplastic constructional materials but instead is limited in its application to metal materials and the like since the various tongues and grooves and flanges and slots necessarily must be constructed from a material which will yield and break and then stay in place after being formed. Plastic materials, such as vinyl, which are used in modern window constructions do not lend themselves to such constructional methodology.

SUMMARY OF THE INVENTION

The present invention provides an exceedingly simple construction which avoids many, if not all, of the aforementioned problems inherent in the prior art block and tackle devices. In its broadest application, the present invention simply provides a pre-assembled, unitary, spring loaded, block and tackle balance assembly adapted for providing vertical support for a window sash running in an elongated, generally upright sash run having a guide channel comprising flange means defining a longitudinal slot extending along the plow region of the sash run. In accordance with the invention, the assembly is easily preassembled and is made up of economical discrete components adapted for being formed, for example, by such procedures as casting, molding, extrusion and/or simple forming by bending long flat strips along longitudinally extending bend lines. Moreover, the present invention provides an assembly which is readily attached to and detached from modern plastic jam liners with a minimum of effort. In this regard, the assembly of the present invention is particularly useful in connection with modern jam liners which are extruded from thermoplastic materials such as vinyl.

In connection with the present invention, the means for holding the assembly in the sash run are deliberately provided as discrete components formed separately from the housing itself to facilitate manufacture and alignment during assembly and positioning. Moreover, the shape and positioning of the means which hold the overall assembly in operational position are more capable of close control as a result of the present invention. Additionally, since the means which are used to hold the block and tackle assembly in position are discrete from the housing, the positioning of the block and tackle mechanism in the jam liner itself is greatly facilitated due to the fact that the holding components are capable of slight movements and adjustments relative to the housing to thereby facilitate alignment while the overall assembly is attached to the jam liner.

In particular, the assembly of the present invention comprises an elongated, general U-shaped housing having a pair of generally parallel, laterally spaced side walls and an outer wall interconnecting the side walls. The outer wall and the side walls together define an elongated chamber having an elongated open side located across from the outer wall of the housing.

Block and tackle spring balance means are disposed within the chamber, such spring balance means being adapted for operable connection to the window sash in supporting relationship thereto. The assembly also includes a first securing means which is discrete from the housing and includes first slide means configured for slidably interengaging the guide channel, and means for mounting the first securing means in the chamber in a fixed longitudinal position, with the first slide means disposed adjacent the open side of the chamber.

The assembly further includes a second securing means which is also discrete from the housing and which is fixed in the chamber in longitudinally spaced relationship to the first securing means. The second securing means also includes second slide means disposed adjacent the open side of the chamber and configured for slidably interengaging with the guide channel. Also included as a part of the assembly is a support means for holding the assembly in a fixed longitudinal position relative to the guide channel. With these components, the entire preassembled assembly may be conveniently and easily slidably mounted in the sash run in a fixed position for supporting a window sash and with the block and tackle spring balance means covered by the housing.

In a more specific aspect of the invention, the securing element and the support means are integrally interconnected and together present a single cap element. More particularly, the cap element is designed for being positioned at one end of the housing and desirably is formed, as by pressure or injection molding, from a thermoplastic material such as vinyl.

In another more specific and preferred aspect of the invention, the first securing element is fixedly mounted on a sheave carrier means that is part of the block and tackle spring balance means. In accordance with this aspect of the invention, the mounting means is operable for mounting the sheave carrier means and the first securing means in a fixed position in the chamber. Even more preferably, the first slide means, includes foot means configured to extend through the slot of the guide channel and to interengage with the flange means in sliding relationship thereto inside the guide channel. In a more particularized version of the invention, the foot means comprises a pair of spaced, generally L-shaped foot members adapted for slidably engaging with the flange means on respective opposite sides of the slot. Generally speaking, the preferred material of construction for the sheave carrier means and the first securing element is a metal which can be shaped as by molding or casting.

In an even more particularized version of the invention, the second slide means, which is part of the second securing means, includes blade means configured to extend through the slot of the guide channel and interengage with the flange means in sliding relationship thereto inside the guide channel. Preferably, the blade means comprises a blade member which has a lateral dimension that is greater than the width of the slot, thus presenting laterally spaced wing areas adapted for slidably interengaging with the flange means on respective opposite sides of the slot.

In another more particular aspect of the invention, the support means for holding the assembly in a fixed longitudinal position relative to the guide means comprises a plate member sized and configured for contacting the free end of the guide channel in assembly supporting relationship thereto.

DETAILED DESCRIPTION OF THE PREFERRED EMBODIMENTS

Figure 1:
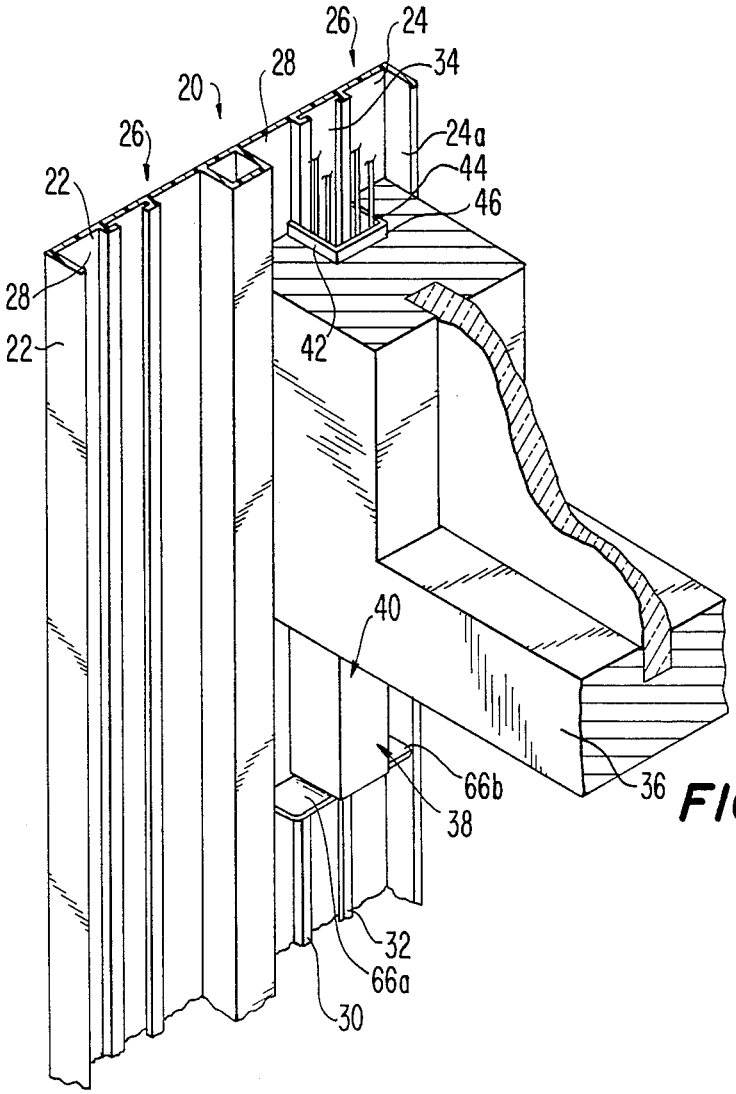
FIG. 1 is a partial perspective view illustrating a vertical sash run and the lower corner of a window sash in sliding disposition in the sash run and in slightly raised position above its normal position resting on the supporting elements therefor which are part of the spring loaded block and tackle assembly of the present invention.

A vertical sash run element of the sort which is preferably utilized in conjunction with the present invention is illustrated in FIG. 1 where it is broadly designated by the reference numeral 20. Sash run 20, which may also be known as a window jamb liner and generally is capable of providing weather stripping and/or weather sealing characteristics to the overall window construction, includes a pair of essentially identical, side-byside runs 22 and 24, each of which is provided with a generally C-shaped guide channel 26 disposed in the plow area 28 thereof. Sash runs 22 and 24 are essentially the same in all structural and operational details, and as is known to those skilled in the art to which the present invention pertains, in actual usage one is used as an upper sash run and the other is used as a lower sash run. In essence, the only difference between runs 22 and 24 is that outer wall 24*a* of run 24 flexs to the left viewing FIG. 1 to provide a certain measure of friction and weather sealing contact against sash 36 while corresponding outer wall 22*a* flexs toward the right for the same essential purpose relative to a sash mounted in run 22. Since runs 22 and 24 and the respective block and tackle spring balance mechanisms used therewith are essentially the same, the invention will be described with reference only to run 24 and its respective block and tackle spring balance mechanism.

Figure 2:
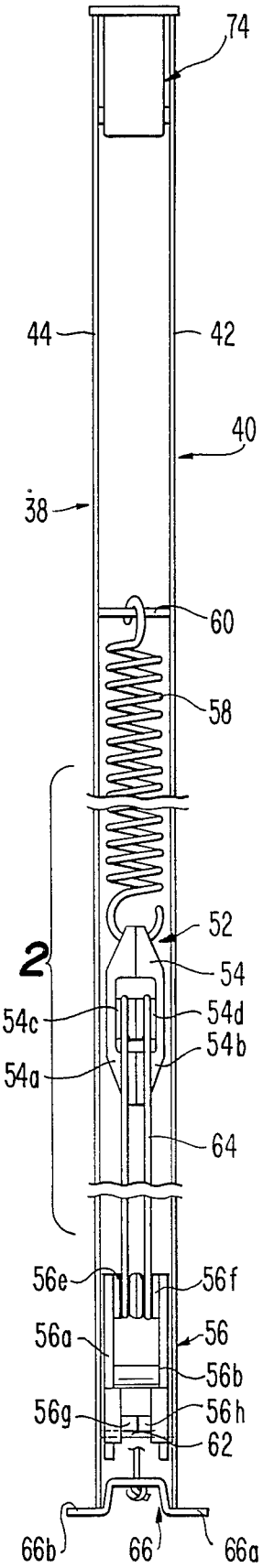
FIG. 2 is an elevational view of the unitary, spring loaded, block and tackle balance assembly of the present invention, viewing the same from the open side of the housing chamber.

Guide channel 26 extends vertically in sash run 24, and as can be seen in FIG. 1, channel 26 includes a pair of laterally spaced, vertically extending, co-planar flanges 30 and 32. A vertically extending slot 34 is defined between flanges 30 and 32. A window sash 36, only a fragmentary portion of which is shown in FIG. 1, is disposed in a vertically slidable disposition in sash run 24. For clarity, in FIG. 1 sash 36 is illustrated in a slightly raised position relative to its normal operating position where, as well known to those of ordinary skill in the art, it would be operably connected to and supported by a unitary, spring loaded, block and tackle balance assembly broadly designated by the reference numeral 38. FIG. 2 illustrates the unitary, spring loaded, block and tackle balance assembly 38 as it would appear prior to being operably installed in sash run 24 or 22 as the case might be.

With particular reference to FIG. 2, assembly 38 of the present invention comprises an elongated, generally U-shaped housing 40 which, in the preferred embodiment of the invention, is preferably constructed of a bendable sheet metal material such as aluminum or steel. As can best be seen in FIGS. 3, 4, and 5, housing 40 has a pair of generally parallel, laterally spaced side walls 42 and 44 and an outer wall 46 which interconnects side walls 42 and 44. Walls 42, 44 and 46 together define an elongated chamber 48 which has an elongated open side 50 located across chamber 48 from outer wall 46.

Assembly 38 also includes block and tackle spring balance means 52 disposed within chamber 48. The spring balance means 52 is operably connected to sash 36 in a supporting relationship thereto as will be explained in greater detail hereinbelow. Spring balance means 52 includes upper sheave carrier means 54 and lower sheave carrier means 56. The upper end of sheave carrier means 54 is provided with a transverse eyelet (not shown) for connection to the lower end of a balance spring 58 in a conventional manner. The upper end of spring 58 is suspended from a rivet 60 which extends across housing 40 as shown in Fig. 2. Sheave carrier 54 is preferably of a two piece construction and the two pieces **54*a* and 54*b* are joined together by a rivet (not shown) which extends through the middle portion of sheave carrier 54 and provides an axle upon which sheaves 54*c* and 54*d*** are mounted in side-by-side relationship for individual and relative rotation.

Lower sheave carrier means 56 also is preferably of a two piece construction and the segments **56*a* and 56*b* thereof are held together by a pair of generally cylindrical connectors 56*c* and 56*d*. Sheaves 56*e* and 56*f* are mounted in side-by-side relationship for individual and relative rotation on connector 56*c* while spacer connector 56*d* simply provides means for maintaining portions 56*a* and 56*b* in correctly spaced relationship relative to one another. A pair of spacing shoulders 56*g* and 56*h* cooperate with spacer 56*d* to maintain the portions 56*a* and 56*b* in a correctly aligned condition to facilitate the proper operation of lower sheave carrier means 56. Sheave carrier portions 56*a* and 56*b* are provided with respective holes 56*i* and 56*j* and the lower sheave carrier means 56 is mounted in housing 40 by mounting means comprised of a rivet 62 which extends through holes 62*a* and 62*b* in housing 40 and holes 56*i* and 56*j* in sheave carrier means 56**, as can best be seen in FIG. 4.

The lower end of upper sheave carrier means 54 is provided with another transverse eyelet (not shown) for receiving one end of a stout cord or cable 64 which extends therefrom and is entrained around sheaves **56*f*, 54*d*, 56*e* and 54*c* respectively and in seriatim, in a conventional manner. Cord 64 then extends downwardly from sheave 54*c* toward the lower end of housing 40 where it is connected to a platform 66 configured and adapted to support the lower edge of window sash 36 when the latter is lowered from the position shown in FIG. 1. In this regard, as is well known to those skilled in the window art, the sash is provided with a vertically extending cut out portion or kerf in the usual manner, such portion being of a size to accommodate and span housing 40 and present a pair of spaced segments disposed on opposite sides of housing 40, the bottom edges of which segments are positioned to rest on and be supported by the respective portions 66*a* and 66*b* of platform 66 in the usual and customary manner. Thus, block and tackle spring balance means 52 will be operably connected to sash 36 in supporting relationship thereto. In this same regard, the spring loaded block and tackle balance assembly 52 will provide vertical support for window sash 36**.

In passing, it should simply be noted that rivet 62 provides means for mounting the lower sheave carrier means 56 in chamber 48 and that sheave carrier means 56 is a separate discrete component which is connected to housing 40 only by rivet 62. Moreover, rivet 62 provides a hanger for balance spring 58. It should also be noted, that in the preferred form of the invention illustrated in FIGS. 1 through 5, the block and tackle device 52 provides a 4 to 1 advantage and travel ratio whereby a downward movement of platform 66 results in an elongation of balance spring 58 which is only one fourth as great as the movement of the sash supported by platform 66. That is to say, a 4 inch movement of platform 66 results in only a 1 inch elongation of the balance spring 58. Finally, in the preferred form of the invention, sheaves **54*c*, 54*d*, 54*e* and 54*f*** may be formed, as by injection molding, from a thermoplastic material such as vinyl or the like.

Figure 3:
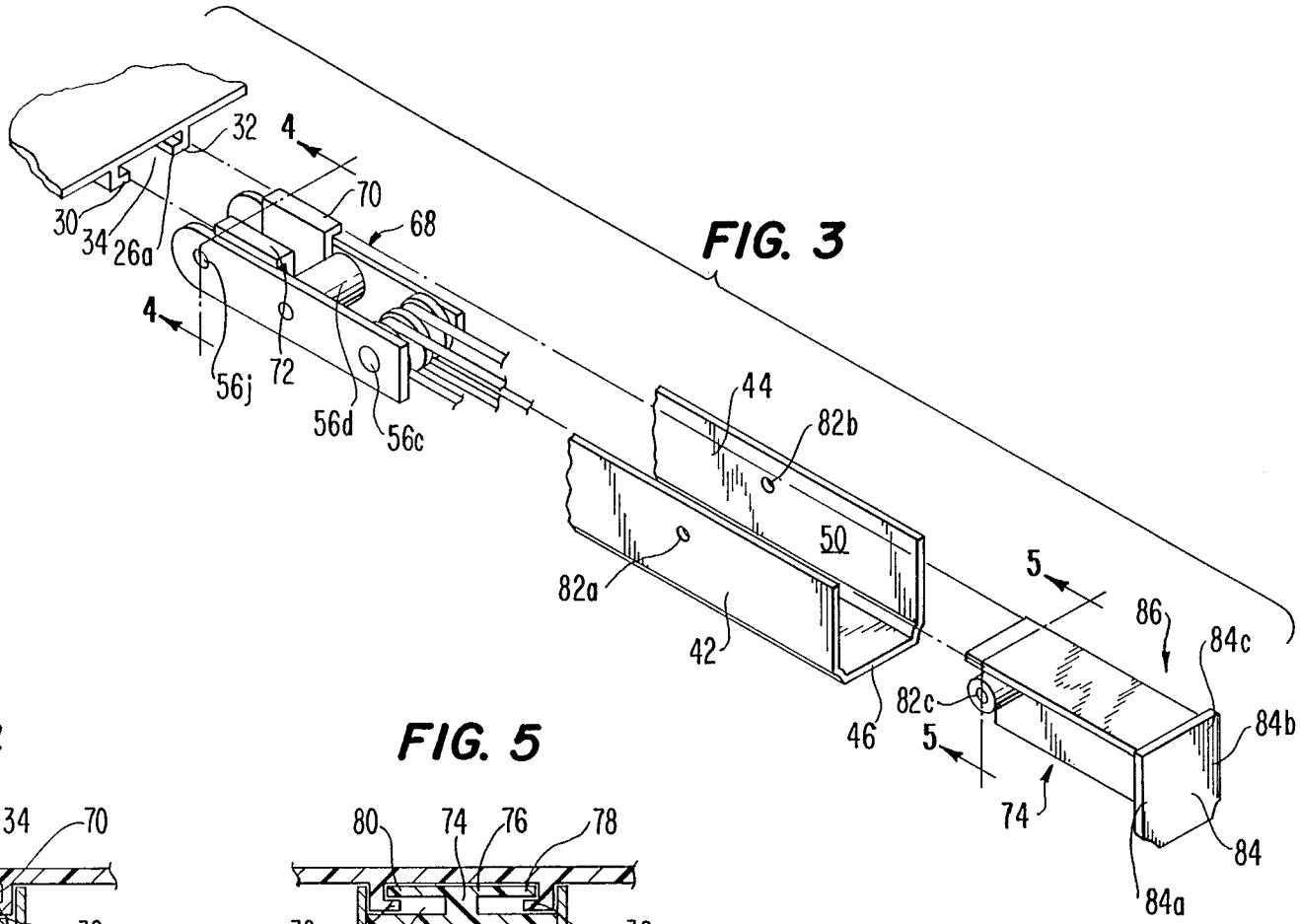
FIG. 3 is a fragmentary, exploded, perspective view of the assembly of FIG. 2, illustrating the sheave carrier means, the securing element and the housing, all in their preferred disposition for being slidably interengaged with the guide channel.
Figure 4:
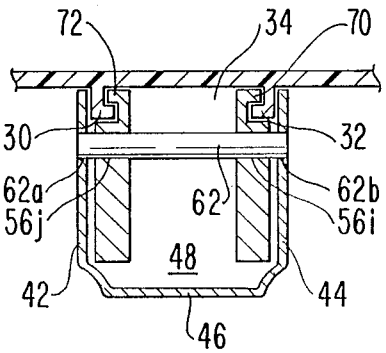
FIG. 4 is a cross-sectional view taken along line 4—4 of FIG. 3 after the sheave carrier means has been slidably interengaged with the guide channel.

As best illustrated in FIG. 3, discrete securing means in the nature of a slide means 68 is fixedly mounted on lower sheave carrier means 56. Slide means 68 is configured and adapted for slidably interengaging with guide channel 26. As can be seen particularly in FIG. 4, slide means 68 comprises foot means in the nature of L-shaped foot members 70 and 72 disposed adjacent the elongated opening 50 of chamber 40. Foot members 70 and 72 are configured to extend through slot 34 and engage with flanges 30 and 32 inside of channel 26 and on opposite sides of slot 34. This can particularly be seen viewing FIG. 4.

Figure 5:
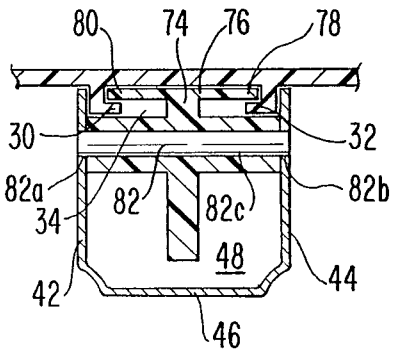
FIG. 5 is a cross-sectional view taken along the line 5—5 of FIG. 3 after the securing element has been slidably interengaged with the guide channel

As can be best seen in FIG. 3, assembly 38 of the invention, in its preferred form, also includes a securing element 74 disposed in longitudinally spaced relationship relative to slide means 68. As can be seen in FIG. 5, securing element 74 includes slide means in the form of a blade member 76 disposed adjacent opening 50. Blade member 76 has a lateral dimension which is greater than the width of slot 34 and thus presents a pair of spaced wing areas 78 and 80 which are configured to interengage with flanges 30 and 32 on opposite sides of slot 34 and within a channel 26. As shown in FIGS. 3 and 5, a rivet 82 cooperates with holes **82*a* and 82*b* in housing 40 and elongated hole 82*c* in securing element 74 to provide means for fixing the securing element 74 in chamber 48, and in this regard it is to be noted, that in accordance with the invention, the securing element 74 is a separate discrete component from housing 40. Thus, blade 76 and its wing areas 78 and 80 provide slide means adapted for slidably interengaging with guide channel 26**.

The unitary, spring loaded, block and tackle balance assembly 38 of the present invention also includes support means in the nature of a plate 84 for holding assembly 38 in a fixed position relative to sash run 24 and guide channel 26. Plate 84 includes shelf areas **84*a*, 84*b* and 84*c* which are positioned, sized and configured for contacting the free end 26*a* of guide channel 26 in a relationship for providing vertical support for the entirety of assembly 38 in its sash carrying position. Preferably, as best illustrated in FIGS. 2 and 3, securing element 74 and plate 84 may preferably be molded as a single piece from a thermoplastic material such as vinyl so that together they present an integral cap element 86**.

As can be seen viewing FIGS. 2 and 3, assembly 38 may be slidably mounted in sash run 24 by virtue of the slidable interengagement, first of foot members 70 and 72 and second of wing areas 78 and 80 with the internal surfaces of flanges 30 and 32. As assembly 38 is then further slidably engaged within channel 26, shelf areas **84*a*, 84*b* and 84*c* come into contact with the free end 26*a* of guide channel 26, whereupon assembly 38 is fully supported in run 24 in a position to provide spring balanced support for sash 36, with the slide means 68 and slide means 76 interengaged in channel 26 for holding the assembly against the plow region 28, with the plate 84 interengaged with the free end 26*a* of channel 26 for holding the assembly in correct vertical position, and with the block and tackle spring balance means 52 covered completely by housing 40**.

We claim:

1. A unitary, spring loaded, block and tackle balance assembly adapted for providing vertical support for a window sash running in an elongated, generally upright sash run having a guide channel comprising flange means defining a longitudinal slot extending along a plow region of the sash run, said assembly comprising:

an elongated, generally U-shaped housing having a pair of generally parallel, laterally spaced side walls and an outer wall interconnecting the side walls, said outer wall and said side walls together defining an elongated chamber having an open side located across from said outer wall;

block and tackle spring balance means in said chamber and adapted for being operably connected to said sash in supporting relationship thereto;

first securing means discrete from said housing and including first slide means configured for slidably interengaging said guide channel;

means for mounting said first securing means in said chamber in a generally fixed longitudinally position with said first slide means adjacent said open side of the chamber;

second securing means discrete from the housing and fixed in said chamber in longitudinal spaced relationship to said first securing means, said second securing means including second slide means disposed adjacent said open side of the chamber and configured for slidably interengaging said guide channel; and support means for holding said assembly in a fixed longitudinal position relative to said guide channel during running of the window sash in the sash run, whereby said assembly may be slidably received in said sash run during attachment in the latter and thereby mounted in the said fixed position relative to the guide channel for supporting a window sash with said block and tackle spring balance means covered by said housing.

2. The invention of claim 1 wherein said second securing means and said support means are integrally interconnected and together present a single cap element.

3. The invention of claim 2 wherein said cap element is disposed at an end of the housing, there being included means for holding said cap element in a fixed position relative to said housing.

4. The invention of claim 2 wherein said cap element is formed of a thermoplastic material.

5. The invention of claim 3 wherein said cap element is formed of a thermoplastic material.

6. The invention of claim 1 wherein said first slide means includes foot means configured to extend through the slot of the guide channel and interengage with said flange means in sliding relationship thereto inside the guide channel.

7. The invention of claim 6 wherein said foot means comprises a pair of spaced, generally L-shaped foot members adapted for slidably interengaging with said flange means on respective opposite sides of the slot.

8. The invention of claim 1 wherein said spring balance means includes sheave carrier means discrete from said housing and said first slide means is fixedly carried by said sheave carrier means, said means for mounting being operable for mounting said sheave carrier means and said first slide means in a fixed longitudinal position within said chamber

9. The invention of claim 8 wherein said first slide means includes foot means configured to extend through the slot of the guide channel and interengage with said flange means in sliding relationship thereto inside the guide channel.

10. The invention of claim 9 wherein said foot means comprises a pair of spaced, generally L-shaped foot members adapted for slidably interengaging with said flange means on respective opposite sides of the slot.

11. The invention of claim 9 wherein said sheave carrier means and said first slide means are integrally formed from a metal material.

12. The invention of claim 1 wherein said second slide means includes blade means configured for extending through the slot of the guide channel and for interengaging with said flange means in sliding relationship thereto inside the guide channel.

13. The invention of claim 12 wherein said blade means comprises a blade member which has a lateral dimension greater than the width of the slot and presents a pair of laterally spaced wing areas adapted for slidably interengaging with said flange means on respective opposite sides of the slot.

14. The invention of claim 3 wherein said second slide means includes blade means configured for extending through the slot of the guide channel and for interengaging with said flange means in sliding relationship thereto inside the guide channel.

15. The invention of claim 14 wherein said blade means comprises a blade member which has a lateral dimension greater than the width of the slot and presents a pair of laterally spaced wing areas adapted for slidably interengaging with said flange means on respective opposite sides of the slot.

16. The invention of claim 15 wherein said support means comprises a plate member sized and configured for contacting the end of said guide channel in assembly supporting relationship thereto.

17. The invention of claim 8 wherein said sheave carrier means is formed of metal.

* * * * *

UNITED STATES PATENT AND TRADEMARK OFFICE

CERTIFICATE OF CORRECTION

PATENT NO. : 4,949,425

DATED : August 21, 1990

INVENTOR(S) : EARL L. DODSON and FREDERICK P. STROBL, JR.

It is certified that error appears in the above-identified patent and that said Letters Patent is hereby corrected as shown below:

Column 4, line 20, "side-byside" should be --side-by-side--.

Column 8, line 14, "chamber" should be --chamber.--.

Signed and Sealed this

Twenty-sixth Day of November, 1991

*Attest:*

HARRY F. MANBECK, JR.

*Attesting Officer*

*Commissioner of Patents and Trademarks*